US009821176B2

(12) United States Patent
Valdes

(10) Patent No.: US 9,821,176 B2
(45) Date of Patent: Nov. 21, 2017

(54) RIGGING LINK BELT BUCKLE DEVICE

(71) Applicant: Carel Valdes, Hialeah, FL (US)

(72) Inventor: Carel Valdes, Hialeah, FL (US)

( * ) Notice: Subject to any disclaimer, the term of this patent is extended or adjusted under 35 U.S.C. 154(b) by 256 days.

(21) Appl. No.: 14/551,286

(22) Filed: Nov. 24, 2014

(65) Prior Publication Data

US 2016/0144208 A1 May 26, 2016

(51) Int. Cl.
*A44B 1/04* (2006.01)
*A62B 35/00* (2006.01)
*A44B 11/25* (2006.01)

(52) U.S. Cl.
CPC ..... *A62B 35/0031* (2013.01); *A44B 11/25* (2013.01); *A44B 11/258* (2013.01)

(58) Field of Classification Search
CPC ..... A62B 35/0031; A62B 35/0037; A62B 35/0025; A62B 35/00; A62B 35/0012; A62B 35/0006; A62B 35/0018; A44B 11/005; A44B 11/25; A44B 11/258; A44B 11/28; Y10T 24/3401; Y10T 24/2136; Y10T 24/2102; Y10T 24/4077; Y10T 24/4086; Y10T 24/3416; Y10T 24/45979
See application file for complete search history.

(56) References Cited

U.S. PATENT DOCUMENTS 58,430 A * 10/1866 Kelsey ..... A44B 11/2526 24/193
1,772,393 A * 8/1930 Guttman ..... A44B 11/28 24/372
1,877,704 A * 9/1932 Switlik ..... B64D 25/06 182/3
2,219,674 A * 10/1940 Zola ..... A44B 11/28 24/182
2,344,031 A * 3/1944 De Shano ..... A62B 35/0006 182/6
2,372,558 A * 3/1945 Dowd ..... A62B 35/0031 24/200
3,165,168 A * 1/1965 Rose ..... A62B 35/00 182/3
3,463,545 A * 8/1969 Curran ..... B60R 22/02 24/307
3,566,454 A * 3/1971 Schmidt ..... A44B 11/24 24/165
3,579,745 A * 5/1971 Wilson ..... A45F 5/02 24/307
4,135,267 A * 1/1979 McKinney, Sr. ..... B25F 1/00 24/163 K
4,146,268 A * 3/1979 Bost ..... B60R 22/30 297/475
4,610,056 A * 9/1986 Emmert ..... A44B 11/12 24/193

(Continued)

*Primary Examiner* — Victor Batson
*Assistant Examiner* — Matthew Sullivan

(57) ABSTRACT

A rigging link belt buckle device comfortably attaches a rescue tether to a rigging link in alignment with a buckle of a belt. The device includes a buckle having a first section and a second section. The first section is selectively engageable to the second section securing the buckle in a closed position such that the buckle secures a belt to a person. A rigging link is extendable away from the buckle to define a loop with the buckle. The rigging link is configured for coupling to a tether such that force exerted on the rigging link by the tether is aligned with the buckle.

10 Claims, 3 Drawing Sheets

(56) References Cited

U.S. PATENT DOCUMENTS

| | | | | |
|---|---|---|---|---|
| 4,667,624 | A | 5/1987 | Smith | |
| 4,778,033 | A * | 10/1988 | Gonzalez | A62B 35/0031 128/878 |
| D367,142 | S | 2/1996 | Platt | |
| 6,015,073 | A | 1/2000 | Vojciak et al. | |
| 6,732,834 | B2 * | 5/2004 | Colorado | A62B 35/0037 182/3 |
| 7,073,627 | B2 * | 7/2006 | Casebolt | A62B 35/0037 119/770 |
| 8,727,073 | B2 * | 5/2014 | Lang | A62B 35/0018 182/3 |
| 9,101,789 | B2 * | 8/2015 | Schierenbeck | A62B 35/0012 |
| 2009/0095232 | A1 | 4/2009 | McKay | |
| 2011/0067953 | A1 | 3/2011 | Kopp | |
| 2014/0007387 | A1 * | 1/2014 | Voinov | A44B 11/25 24/591.1 |
| 2015/0289598 | A1 * | 10/2015 | Hsiung | A44B 11/005 128/202.27 |
| 2016/0037868 | A1 * | 2/2016 | Lambert | A45C 13/1069 24/303 |

* cited by examiner

RIGGING LINK BELT BUCKLE DEVICE

BACKGROUND OF THE DISCLOSURE

Field of the Disclosure

The disclosure relates to belt buckle devices and more particularly pertains to a new belt buckle device for attachment of a rescue tether in alignment with a buckle of a belt.

SUMMARY OF THE DISCLOSURE

An embodiment of the disclosure meets the needs presented above by generally comprising a buckle having a first section and a second section. The first section is selectively engageable to the second section securing the buckle in a closed position such that the buckle secures a belt to a person. A rigging link is extendable away from the buckle to define a loop with the buckle. The rigging link is configured for coupling to a tether such that force exerted on the rigging link by the tether is aligned with the buckle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
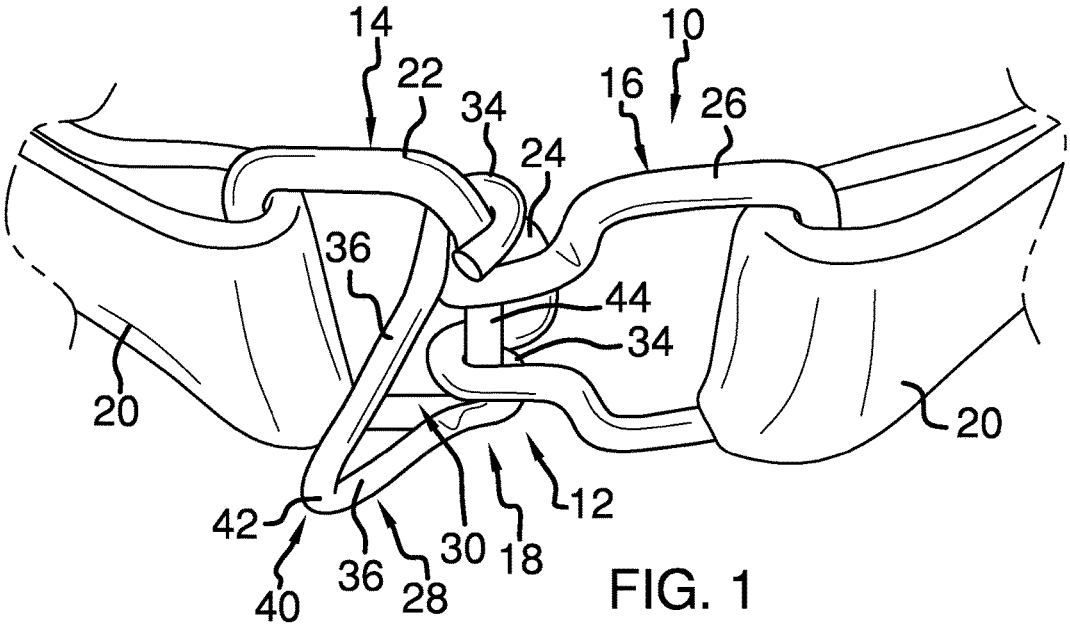
FIG. 1 is a top front view of a rigging link belt buckle device according to an embodiment of the disclosure.
Figure 2:
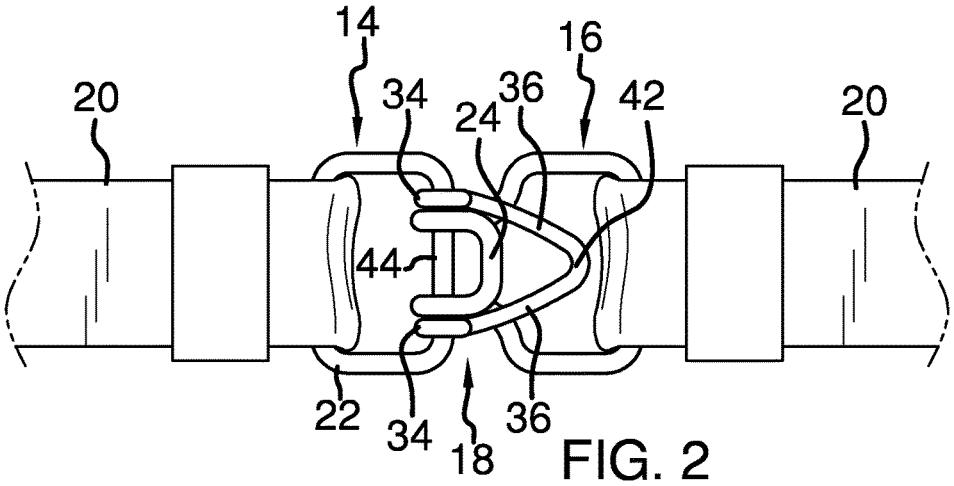
FIG. 2 is a front view of an embodiment of the disclosure.
Figure 3:
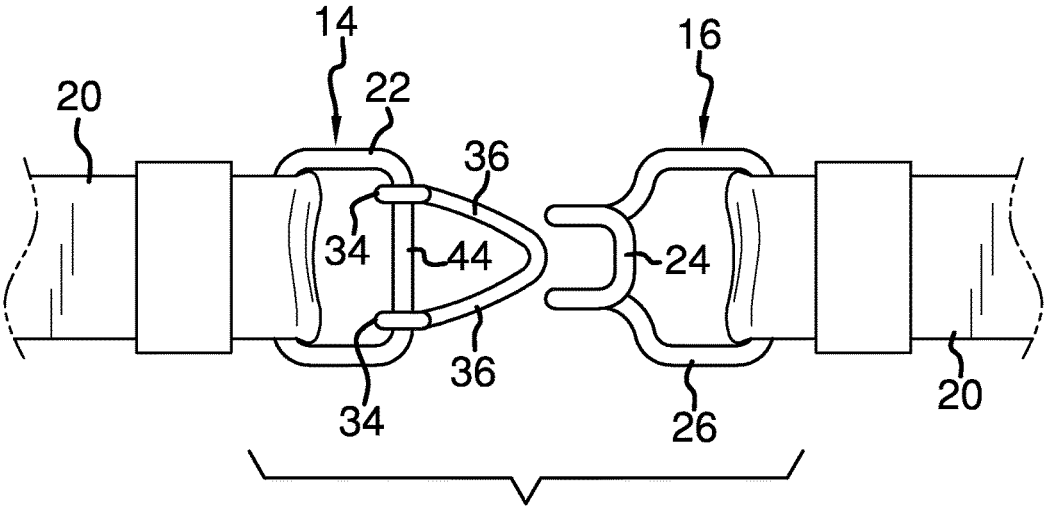
FIG. 3 is a front view of an embodiment of the disclosure in an open position.
Figure 4:
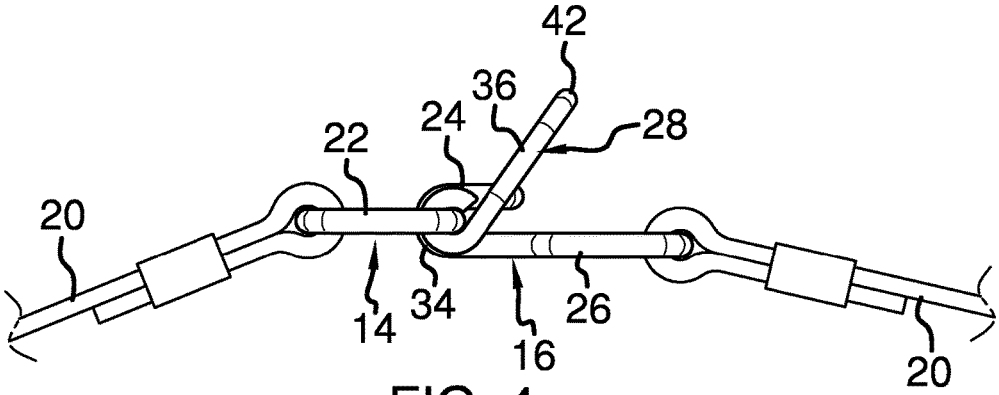
FIG. 4 is a top view of an embodiment of the disclosure.
Figure 5:
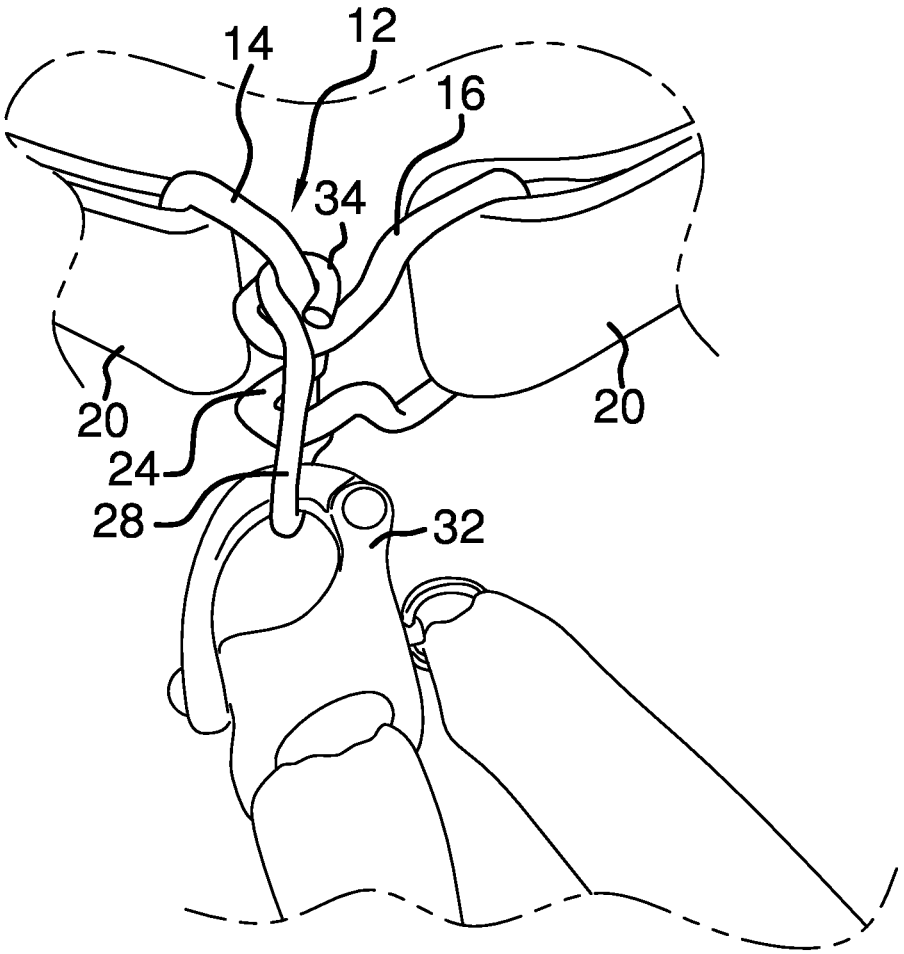
FIG. 5 is a front top view of an embodiment of the disclosure in use.

With reference now to the drawings, and in particular to FIGS. 1 through 5 thereof, a new belt buckle device embodying the principles and concepts of an embodiment of the disclosure and generally designated by the reference numeral 10 will be described.

As best illustrated in FIGS. 1 through 5, the rigging link belt buckle device 10 generally comprises a buckle 12 having a first section 14 and a second section 16. The first section 14 is selectively engageable to the second section 16 wherein the buckle 12 is secured in a closed position 18 such that the buckle 12 is configured for securing a belt 20 to a person. The belt 20 may be an armed forces or law enforcement duty belt, a safety harness, or the like. The first section 14 of the buckle 12 is a ring 22. The ring 22 is rectangular. The second section 16 of the buckle 12 has a hook section

24. The hook section 24 is engageable to the ring 22 wherein the second section 16 is coupled to the first section 14. The hook section 24 may extend forwardly from a substantially planar main portion 26 of the second section 16 of the buckle 12. The buckle 12 is reversible such that the buckle 12 may be closed with the hook section 24 facing towards or away from the person.

A rigging link 28 is coupled to the buckle 12 such that the rigging link 28 is extendable away from the buckle 12 to define a loop 30 with the buckle 12. Thus, the rigging link 28 is configured for coupling to a tether 32 such that force exerted on the rigging link 28 by the tether 32 is aligned with the buckle 12. The tether 32 may be part of a harness, line, rope, strap, or the like, used to facilitate moving an injured or incapacitated person. The rigging link 28 has a pair of opposite ends 34. The opposite ends 34 are spaced apart and coupled to the buckle 12. Each of the opposite ends 34 is pivotally coupled to the buckle 12. The rigging link 28 further comprises a pair of side sections 36. Each side section 36 extends from a respective one of the opposite ends 34 of the rigging link 28. A junction 40 of the side sections 36 defines a medial section 42 of the rigging link 28 positionable in spaced relationship to the buckle 12 by pivoting of the rigging link 28. The medial section 42 of the rigging link 28 is arcuate. The side sections 36 are angled such that the rigging link 28 is tapered extending from the opposite ends 34 to the medial section 42 of the rigging link 28.

More specifically, the rigging link 28 is coupled to and extends from the first section 14 of the buckle 12. The opposite ends 34 of the rigging link 28 are coupled to a longitudinal side 44 of the ring 22 opposite where the ring 22 is attached to the belt 20. The hook section 24 is positionable to engage the longitudinal side 44 of the ring 22 between the opposite ends 34 of the rigging link 28. Further, the opposite ends 34 of the rigging link 28 abut the hook section 24 when the hook section 24 is engaged to the longitudinal side 44 of the ring 22.

In use, the belt 20 is worn by a user. When needed, the tether 32 is attached to the rigging link 28. The tether 32 may be attached to a person or thing to be moved. The user wearing the belt 20 may then use leg strength to pull on the tether 32 while leaving hands free. Thus, the device 10 may be utilized to allow the user to drag a person engaged by the tether to safety in a combat environment while leaving the hands of the user free to operate weapons, communications devices, or the like. The force exerted on the rigging link 28 from the tether 32 enhances securement of the first section to the second section of the buckle and pulls the buckle 12 away from the user such that the buckle 12 does not abrade or cause discomfort to the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rigging link belt buckle device comprising:

a buckle having a first section and a second section, said first section being selectively engageable to said second section wherein said buckle is secured in a closed position such that said buckle is configured for securing a belt to a person, said first section of said buckle being a ring, said second section of said buckle having a hook section, said hook section being engageable to said ring wherein said second section is coupled to said first section; and a rigging link pivotally coupled to said buckle such that said rigging link is extendable away from said buckle to define a loop with said buckle wherein said rigging link is configured for coupling to a tether such that force exerted on said rigging link by the tether is aligned with said buckle, said buckle remaining closed throughout a full range of pivoting of said rigging link relative to said buckle, said rigging link being coupled to and extending from said first section of said buckle.

2. The device of claim 1, further comprising said rigging link having a pair of opposite ends, said opposite ends being spaced apart, each of said opposite ends being coupled to said buckle.

3. The device of claim 2, further comprising each of said opposite ends being pivotally coupled to said buckle.

4. The device of claim 2, further comprising said rigging link comprising a pair of side sections, each said side section extending from a respective one of said opposite ends of said rigging link, a junction of said side sections defining a medial section of said rigging link positionable in spaced relationship to said buckle.

5. The device of claim 4, further comprising said medial section of said rigging link being arcuate.

6. The device of claim 4, further comprising said side sections being angled such that said rigging link is tapered extending from said opposite ends to said medial section of said rigging link.

7. The device of claim 1, further comprising:

said ring being rectangular; and opposite ends of said rigging link being coupled to a longitudinal side of said ring.

8. The device of claim 7, further comprising said hook section being positionable to engage said longitudinal side of said ring between said opposite ends of said rigging link.

9. The device of claim 8 wherein said opposite ends of said rigging link abut said hook section when said hook section is engaged to said longitudinal side of said ring.

10. A rigging link belt buckle device comprising:

a buckle having a first section and a second section, said first section being selectively engageable to said second section wherein said buckle is secured in a closed position such that said buckle is configured for securing a belt to a person, said first section of said buckle being a ring, said ring being rectangular, said second section of said buckle having a hook section, said hook section being engageable to said ring wherein said second section is coupled to said first section; and a rigging link pivotally coupled to said buckle such that said rigging link is extendable away from said buckle to define a loop with said buckle wherein said rigging link is configured for coupling to a tether such that force exerted on said rigging link by the tether is aligned with said buckle, said buckle remaining closed throughout a full range of pivoting of said rigging link relative to said buckle, said rigging link having a pair of opposite ends, said opposite ends being spaced apart, each of said opposite ends being coupled to said buckle, each of said opposite ends being pivotally coupled to said buckle, said rigging link comprising a pair of side sections, each said side section extending from a respective one of said opposite ends of said rigging link, a junction of said side sections defining a medial section of said rigging link positionable in spaced relationship to said buckle, said medial section of said rigging link being arcuate, said side sections being angled such that said rigging link is tapered extending from said opposite ends to said medial section of said rigging link, said rigging link being coupled to and extending from said first section of said buckle, opposite ends of said rigging link being coupled to a longitudinal side of said ring, said hook section being positionable to engage said longitudinal side of said ring between said opposite ends of said rigging link, said opposite ends of said rigging link abutting said hook section when said hook section is engaged to said longitudinal side of said ring.

* * * * *